United States Patent [19]

Sentoku et al.

[11] Patent Number: 4,896,481

[45] **Date of Patent: * Jan. 30, 1990**

[54] COIN RECEIVING AND WRAPPING MACHINE

[75] Inventors: Hideshi Sentoku, Tokyo; Takayoshi Asaoka, Tokyo, both of Japan

[73] Assignee: Laurel Bank Machines Co., Ltd., Tokyo, Japan

[ * ] Notice: The portion of the term of this patent subsequent to Feb. 6, 2007 has been disclaimed.

[21] Appl. No.: 212,598

[22] Filed: Jun. 28, 1988

[30] Foreign Application Priority Data

Jul. 2, 1987 [JP] Japan ..... 62-166025
Jul. 21, 1987 [JP] Japan ..... 62-181430

[51] Int. Cl.[4] ..... B65B 11/04; B65B 57/20

[52] U.S. Cl. ..... 53/501; 53/212; 53/532

[58] Field of Search ..... 53/212, 501, 532; 453/12, 31, 50; 194/350

[56] References Cited

U.S. PATENT DOCUMENTS 1,168,461 1/1916 Batdorf ..... 53/501
4,037,700 7/1977 Heraty ..... 194/350
4,102,110 7/1978 Iizuka ..... 53/212 X

FOREIGN PATENT DOCUMENTS 33792 3/1978 Japan ..... 53/212
55-92990 1/1979 Japan .
5688380 12/1979 Japan .
5984721 11/1982 Japan .
60-135975 2/1984 Japan .
60-135976 2/1984 Japan .
62-208329 2/1986 Japan .
1315971 5/1973 United Kingdom ..... 194/350

*Primary Examiner*—John Sipos
*Attorney, Agent, or Firm*—Fleit, Jacobson, Cohn, Price, Holman & Stern

[57] ABSTRACT

A coin receiving and wrapping machine comprising upper hopper for receiving coins, discriminating sensor for discriminating denominations of coins to introduce a predetermined denomination of coins to be wrapped to one direction and coins other than the predetermined coins to another direction, accumulating section for receiving said predetermined denomination of coins to accumulate them, wrapping section provided downward of said accumulating section for wrapping said predetermined denomination of coins in the form of a coin stack, holding section removably mounted on said machine for temporarily holding the coins from the discriminating section other than said predetermined denomination of coins, selecting box removably mounted on said machine and positioned downward of said holding means for receiving the coins from the holding section and for discharging the coins from the holding means, lower hopper located at the lower portion of the machine for receiving said coins from the selecting box and coins from the outside of the machine. The selecting box is provided with inlet means adapted to be communicated with the holding section when the selecting means is mounted on the machine and provided with outlet means which can be opened by applying a key from the outside of the machine.

5 Claims, 4 Drawing Sheets

COIN RECEIVING AND WRAPPING MACHINE

BACKGROUND OF THE INVENTION

1. Field of the invention

The present invention relates to a coin receiving and wrapping machine, more specifically to a machine for receiving coins and counting and wrapping the coins in the form of a predetermined number of coins in a stack.

2. Description of the Prior Art

Conventionally, in financial companies such as a bank, a massive number of coins are collected from retail stores, then counted and sorted as a daily work. Similarly, in taxi companies, a great amount of money is necessary to be collected from drivers, counted and sorted in a proper way.

For this purpose, a work for counting and classifying the money is necessary in the bank each when money is carried by an employee who collects money. In taxi company, such work is needed each when a taxi driver brings the day's takings. In a conventional process, such money at first is introduced to a receiving machine in which fake coins are excluded and only proper coins are allowed to be sorted and counted. Japanese Patent Public Disclosure No. 55-92990, which is laid open to the public on July 14, 1980, discloses a conventional receiving machine as aforementioned. Thereafter, the coins are introduced into a wrapping machine in which the coins are sorted according to the denomination of coin and wrapped by a predetermined number of coins( a wrapping includes usually 50 coins). Japanese Patent Public Disclosure No. 59-84721, which is laid open to the public on May 16, 1984, discloses such a conventional coin wrapping machine.

However, the conventional money processing as aforementioned has a disadvantage that both coin receiving machine and coin wrapping machine are necessary to that effect. This means that the work for receiving and wrapping coins are complicated because the money must be transferred from the receiving machine to the wrapping machine, and that a large working space is necessary for placing the receiving and wrapping machines. In addition, there may be a problem of safety when the money is transferred between two machines. The money receiving work is necessary to be done each when the money is carried. On the other hand, the wrapping work can be efficiently done as the amount of coins to be wrapped is increased. Accordingly, in the conventional money processing, it is necessary to provide a proper means independently for safekeeping the money temporarily before the coin wrapping work. Further, the conventional coin wrapping machine as disclosed in the Japanese Patent Public Disclosure No. 59-84721 is disadvantageous in that coins are wrapped in size order of diameter thereof because a denomination of coins of larger diameter than a predetermined denomination of coins can be introduced to a coin accumulating section. In other words, in the conventional coin wrapping machine, it is impossible to select a denomination of coins of smaller diameter to be wrapped among various denominations of coins.

SUMMARY OF THE INVENTION

It is therefore object of the present invention to solve the above problems in receiving coins and wrapping the coins by processing the coins in a single coin receiving and wrapping machine.

It is another object of the present invention to provide a coin receiving and wrapping machine which can receive and wrap coins easily and quickly.

It is further object of the present invention to provide a coin receiving and wrapping machine which can keep coins safely and wrap them at an appropriate timing. It is still further object of the invention to provide a coin receiving and wrapping machine to which coins can be easily introduced and taken out of.

According to the present invention, the above and other features of the invention can be accomplished by a coin receiving and wrapping machine comprising upper hopper means for receiving coins to be processed, discriminating means for discriminating denominations of coins to introduce a predetermined denomination of coins to be wrapped to one direction and coins other than the predetermined coins to another direction, accumulating means for receiving said predetermined denomination of coins to accumulate them, wrapping means provided downward of said accumulating means for wrapping said predetermined denomination of coins in the form of a coin stack, holding means removably mounted on said machine for temporarily holding the coins from the discriminating means other than said predetermined denomination of coins, selecting box means removably mounted on said machine and positioned downward of said holding means for receiving the coins from the holding means and for discharging the coins introduced from the holding means, lower hopper means located at the lower portion of the machine for receiving said coins discharged from the selecting box means and coins which are introduced through opening means opened to the outside of the machine, the selecting box means being provided with inlet means adapted to be communicated with the holding means when the selecting means is loaded on the machine and provided with outlet means which can be opened by applying a key from the outside of the machine.

Preferably the machine according to the present invention may comprise storing means for storing the wrapped coins wrapped in the wrapping means.

The present invention may further include transporting means for transporting the coins introduced into the lower hopper means from the lower hopper means to the upper hopper means.

In another aspect, the present invention may further include denomination setting means for setting a denomination of coins to be introduced into the accumulating means to control the discriminating means.

Preferably the coin receiving and wrapping machine according to the present invention further comprises control means for changing a denomination of coins to be introduced into the accumulating means set by the denomination setting means in the order of the number of the coins which pass through the discriminating means based on a discrimination by the discriminating means each when all the coins in the upper hopper are introduced into the discriminating means.

According to the present invention, each when a certain amount of money is introduced in the machine, the money is discriminated, counted and verified. After these processes, a predetermined denomination of coins to wrapped are fed to be the accumulating means and to the wrapping means to be wrapped in the form of a coin stack bar of a predetermined number of coins. Then the wrapped stack bar is kept safely at the storing means for the wrapped coins. On the other hand, coins other than the predetermined denomination of coins are introduced into the holding means to be held temporarily. Thereafter, the coins are fed to the selecting box means and to the lower hopper means. In next stage, the coins may be introduced into the upper hopper means through the transporting means. Alternatively, the coins other than the predetermined denomination of coins to to be wrapped can be kept safely in the selecting box means which can function as a safe if necessary. In this case, since the selecting box means can be removed from the machine, the money in the selecting box can also be in safekeeping in a proper place other than the machine.

The lower hopper means is accessible from the outside of the machine so that a great number of coins can be introduced directly into the machine through the lower hopper means. The coins from the lower hopper means are transferred to the upper hopper means and are discriminated in the discriminating means. A predetermined denomination of coins are fed to the accumulating means and in turn to the wrapping means in which the coins are wrapped in the form of coin stack bar of a predetermined number of coins. The wrapped coin stack bar can be kept safely.

In addition, according to the present invention, a denomination of coin to be wrapped can be selected by the denomination setting means to obtain any denomination of wrapped coin stack bar.

Further the coins introduced into the machine are wrapped in a sequence according to the number of coins in each denomination by utilizing the control means so that the number of coins circulated through the lower hopper means and upper hopper means can be reduced.

The above and other objects of the present invention will be apparent from the following descriptions of preferred embodiment taking reference to the accompanying drawings.

DESCRIPTION OF PREFERRED EMBODIMENTS

Figure 1:
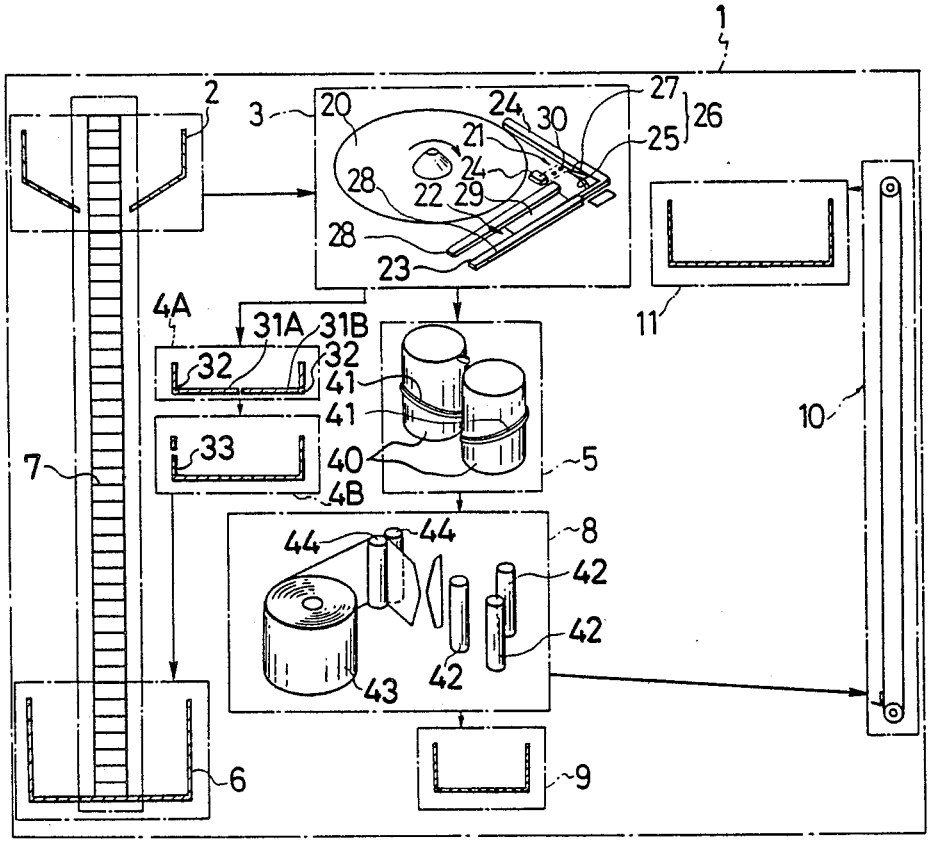
FIG. 1 is a schematic view of a coin receiving and wrapping machine in accordance with the present invention.

Referring to FIG. 1, there is shown a schematic view of a coin receiving and wrapping machine in accordance with the present invention. Specifically FIG. 1 shows generally a layout of main components of the machine in the up and down direction.

The coin receiving and wrapping machine 1 is provided with an upper hopper 2 for receiving coins, a coin discriminating section 3 for discriminating a denomination of the coins and counting the money amount as well as excluding a fake, a holding section 4A disposed under the discriminating section 3 for receiving the coins from the discriminating section 3, and holding them temporarily until all the coins fed to the upper hopper 2 are counted in the discriminating section 3. The holding section 4A is removably mounted on the machine 1. The machine 1 is also provided with an accumulating section 5 under the discriminating section 3 for receiving only a predetermined denomination of coins to be wrapped so as to accumulate therein.

There is provided with a selecting box 4B under the holding section 4A. The selecting box 4B is removably mounted on the machine 1 so as to function as a safe. Under the selecting box 4B disposed is a lower hopper 6 removably mounted on the machine 1 for receiving the coins from the selecting box 4B. The lower hopper 6 is provided with an opening communicating with the outside of the machine 1. A conveyer 7 is disposed beside the lower hopper 6 for transporting the coins from the lower hopper 6 to the upper hopper 2.

There is disposed a wrapping section 8 downward of the accumulating section 5 for wrapping the coins which is accumulated as a coin stack bar of a predetermined number of coins in the accumulating section 5. Under the wrapping section 8 is provided a clear box 9 for storing coins which are excluded from the wrapping process because of an improper wrapping, short in the number of coins or the like. The machine 1 further comprises a conveyer 10 for transporting the coins from the wrapping section 8 to a roll box 11 where wrapped coins are stored as coin stack bars.

The discriminating section 3 is usually constituted by devices disclosed for example in Japanese Utility Model Public Disclosure No. 56-88380 and in Japanese Patent Application No. 62-65348 which is assigned to the same assignee as the present invention. The discriminating section 3 is adapted to detect a fake and discriminate the denomination of coins. For this purpose, The section 3 usually comprises sensors 30 including a material discriminating sensor for discriminating the material of the coins fed thereto and a diameter discriminating sensor for detecting the diameter of the coins whereby the denomination of the coin is discriminated. The material discriminating sensor is usually provided with a magnetic device of a detecting coil for detecting a change in the magnitude of the magnetic field thereof. The diameter discriminating sensor is usually provided with photo array image sensors for detecting the amount of light interrupted by each coin. Signals from counting sensors 30 and the image sensors are fed to a control unit( not shown) which compares the signals with given data stored therein to determine the denomination of the coin. In the discriminating section 3, the number of the coins fed thereto are counted by denomination by counting peak values of the signals so that the total amount of the money can be calculated.

The coins from the upper hopper 2 are introduced to a rotating disc 20 to be discharged in the tangential direction of the disc 2 by a centrifugal force and introduced into a primary selecting passage 21 thereafter a secondary selecting passage 22. While moving in the passages 21 and 22, only a predetermined denomination of coins are allowed to be introduced into the accumulating section 5 through the tip end portion 23 of the secondary selecting passage 22. In the passages 21 and 22, the coins are brought into contact with a conveyer belt (not shown) to be transferred. The primary passage 21 is constituted by a pair of passage members 24, 24 placed in parallel with each other. The distance between the passage members 24, 24 is set at such a dimension that any denomination of coins fed to the machine 1 can pass therethrough. A guide member 26 is disposed in the vicinity of one end of one of the passage members 24. The guide member is formed with a lead wall 25 which is being engaged with a side surface of a predetermined denomination of coins to deflect the moving direction of the coins by substantially 90 degree and lead the coins to the secondary passage 22. The guided member 26 is also formed with an inclined surface 27 in which larger diameter coins than the coins being introduced into the secondary passage 22 climb up and move straight thereafter to be excluded downwardly. The guide member 26 is movable to change a distance to the other of the passage members 24, 24 so that the denomination of coins excluded through the guide member 26 can be changed.

The secondary passage 22 is constituted by a pair of passage rails 28, 28 which are movable to adjust a distance therebetween for conducting only a predetermined denomination of coins to a terminal section 23 thereof. There is formed a selecting opening 29 between the rails 28, 28 so that coins smaller than the distance between the rails 28, 28 fall between the rails 28, 28 to be excluded from the passage 22. The coins excluded from both the primary passage 21 and secondary passage 22 are introduced into the holding section 4A through a proper chute member(not shown).

If the sensors 30 detect a fake or counterfeit, the control unit actuates a solenoid to check the counterfeit to move forwardly by projecting a member on the primary passage 21.

Then the counterfeit is removed from the passage 21 by an operator who is notified by a suitable alarm device. Alternatively, the counterfeit is moved to the opening 29 which allows the counterfeit to fall. Then the counterfeit is introduced into a reject box (not shown) through a gate for excluding the counterfeit.

The holding section 4A is adapted to receive the coins excluded from the primary passage 21 by means of the guide member 26, and the secondary passage 22 by means of the opening 29 and store them temporarily. The coins can be taken out of the holding section 4A by removing or drawing the section 4A from the machine 1.

The holding section 4A is provided with a pair of bottom plates 31A, 31B which are swingably mounted around respective pins 32, 32 to open the bottom portion of the holding section 4A so that the coins in the section 4A can be discharged therefrom downwardly.

The selecting box 4B is constituted by a device as disclosed in Japanese Utility Model Public Disclosure Nos. 60-1359 and 60-135976 which are assigned to the same assignee as the present invention. The selecting box is slidably removably mounted on the machine 1. The selecting box 4B is adapted to receive the coins from the holding box 4A and store them. The selecting box 4B is provided with an opening on the top which is adapted to be opened upwardly to the holding box 4A when the selecting box 4 is loaded on the machine 1, and to be closed when the selecting box 4 is removed from the machine 1. The opening of the selecting box 4 cannot be opened unless a key is applied to open it in the case where the selecting box 4B is removed from the machine 1. The selecting box 4B is provided with a gate 33 at the lower and side portion so that the coins therein can be introduced downwardly into the lower hopper 6 when the gate 33 is opened. In order to facilitate introducing the coins in the box 4B toward the gate 33, a conveyer belt can be provided at the bottom of the selecting box 4B. Alternatively, a bottom plate of the selecting box 4B may be constituted to have an inclination to the gate 33.

The lower hopper 6 fixed to the machine 1 is adapted to store coins which can be taken out by means of the conveyer 7. The hopper 6 can receive coins fed to the machine 1 through a coin inlet which is formed on the machine 1 at a side or front portion by way of a chute, tube or the like.

The conveyer 7 is extended in the up and down direction of the machine 1 and formed with lateral projections which are engaged with coins to transfer upwardly. When the coins are transferred by the conveyer 7 to an upper portion, they are checked by a roller or a deflector(not shown) to be introduced into the upper hopper 2.

The accumulating section 5 as shown in Japanese Patent Public Disclosure No. 59-84721 is adapted to accumulate the coins from the discriminating section 3 in the form of a coin stack bar. In this embodiment, The accumulating section 5 is of a type as shown in Japanese Patent Public Disclosure No. 62-208329 which is assigned to the same assignee as the present invention. The accumulating section 5 is provided with a pair of rotative drums 40, 40 having spiral projections 41, 41 respectively on the external surfaces. As the drum 40, 40 rotate, a supporting point formed by the pair of projections 41, 41 for the coins moves downwardly to allow the stacked coins to grow up.

The wrapping section 8 as shown in Japanese Patent Public Disclosure No. 59-84721 is adapted to wrap the stacked coins from the accumulating section 5.

A predetermined number of coins of a coin stack bar (usually 50) stacked in the accumulating section 5 is fed toward a set of wrapping rolls 42, 42, 42. The coin stack bar is put in between the rolls 42, 42, 42 and wrapped by a wrapping sheet 43 supplied by a pair of feed rolls 44, 44 while rotating.

When trouble occurs in the wrapping section 8 or improper number of coins are introduced in the wrapping section 8, the wrapping roll 42, 42, 42 are separated from one another to discharge the stacked coin downwardly to the reject box 9.

The wrapped coin stack bar is fed to the conveyer 10 through an inclined passage. The conveyer 10 is of a type as shown in Japanese Patent Public Disclosure No. 56-95822 which provided with baskets carried by an endless chain moving in the vertical direction to transfer the wrapped coin stack bar to the roll box 11.

Hereinafter there is described an operation of the machine 1.

Money receiving mode

Figure 2:
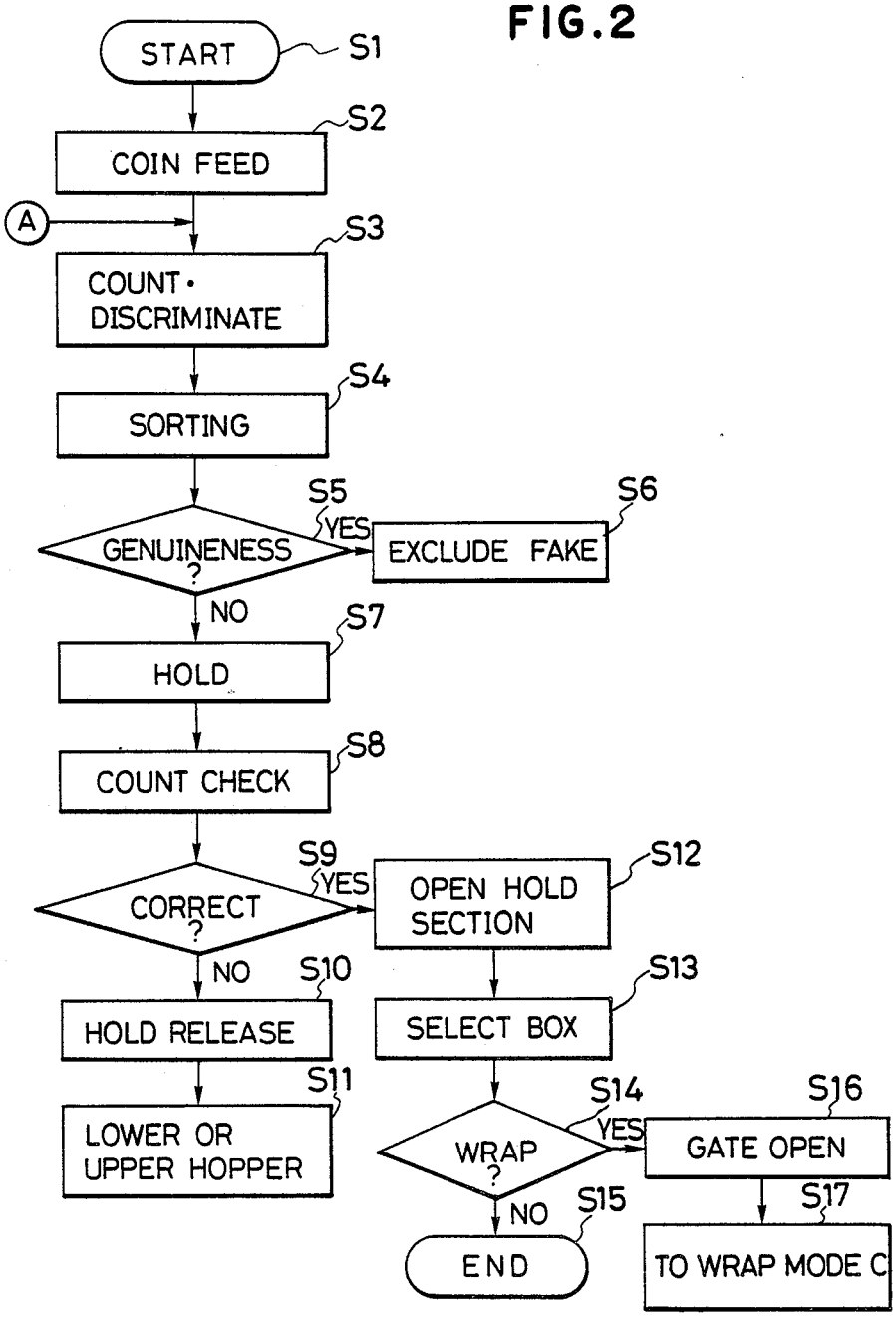
FIG. 2 through FIG. 5 are flow charts showing a control in accordance with the present invention.

As clearly shown in a flow chart of FIG. 2, when coins are fed into the upper hopper by an operator, the coins are introduced to the discriminating section 3 (S1, S2 and S3). In the discriminating section 3, the coins are discriminated with regard to the denomination and genuineness. In this case, the guide member 26 of the primary passage 21 is positioned at the most retracted position where the distance between the guide member 26 and one of the pair of passage members 24, 24 is biggest for introducing any denomination of coins to the secondary passage 22. The passage rails 28, 28 of the secondary passage 22 are positioned to provide the biggest distance between them to allow all the coins to be introduced into the holding section 4A.

Counterfeits are detected by the sensors 30 placed in the vicinity of the inlet of the primary passage 21 (S4, S5) and checked in the passage 21 to be excluded automatically or by the operator (S6).

Genuine coins are fed from the opening 29 to the holding section 4A and stored therein. The result of the discrimination by the sensors 30 is supplied to a control unit in which the amount of the money is counted and notified to the operator by showing in a display device (S7). The operator would check as to whether the amount of the money counted and shown in the display device coincides with the amount of money indicated as being received by a printed receipt (S8, S9).

When the amount of money is not correct, the holding section 4A is removed from the machine 1 (S10). On the other hand, when the amount of money is correct, the operator operates a switch to open the bottom plates 31A, 31B of the holding section 4A (S12) so that the coins in the holding section 4A fall into the selecting box 4B to be stored (S13). The operator decides whether a wrapping is necessary or not (S14). If there is no need to wrap the coins, the process will finish (S15). And where the coins in the selecting box 4B are moved for a safekeeping, the selecting box 4B is removed from the machine 1. When the coins are wrapped, the gate 33 is opened to introduce the coins in the selecting box 4B to the lower hopper 6 (S16). Thereafter, a certain amount of coins are stored in the selecting box 4B, a wrapping mode as shown FIG. 4 will be carried out (S17).

Figure 3:
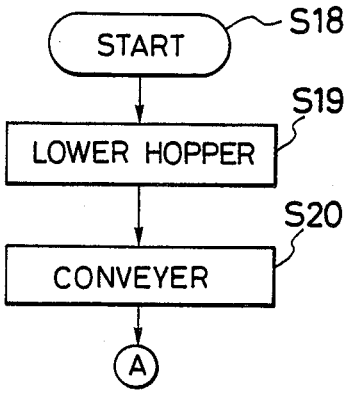

Meanwhile, when a massive number of coins are fed to the machine 1, the coins are fed to the machine 1 through an opening provided slightly upward of the lower hopper 6 in view of the heavy weight of the coins. In this case, as shown in FIG. 3, when the coins are fed to the lower hopper 6, the conveyer 7 is actuated to transfer the coins from the lower hopper 6 to the upper hopper 2 (S18, S19, S20). Thereafter the coins are processed in accordance with step S3 through S17 as aforementioned in connection with FIG. 2.

The holding section 4A can be provided with a locking mechanism such as a magnetic lock mechanism so that the holding section 4A cannot be removed and opened after checking the amount of the money in step S8. In this case, the coins can be taken out through only the selecting box 4B so that the safety of the machine can be improved.

Wrapping and storing mode

Figure 4:
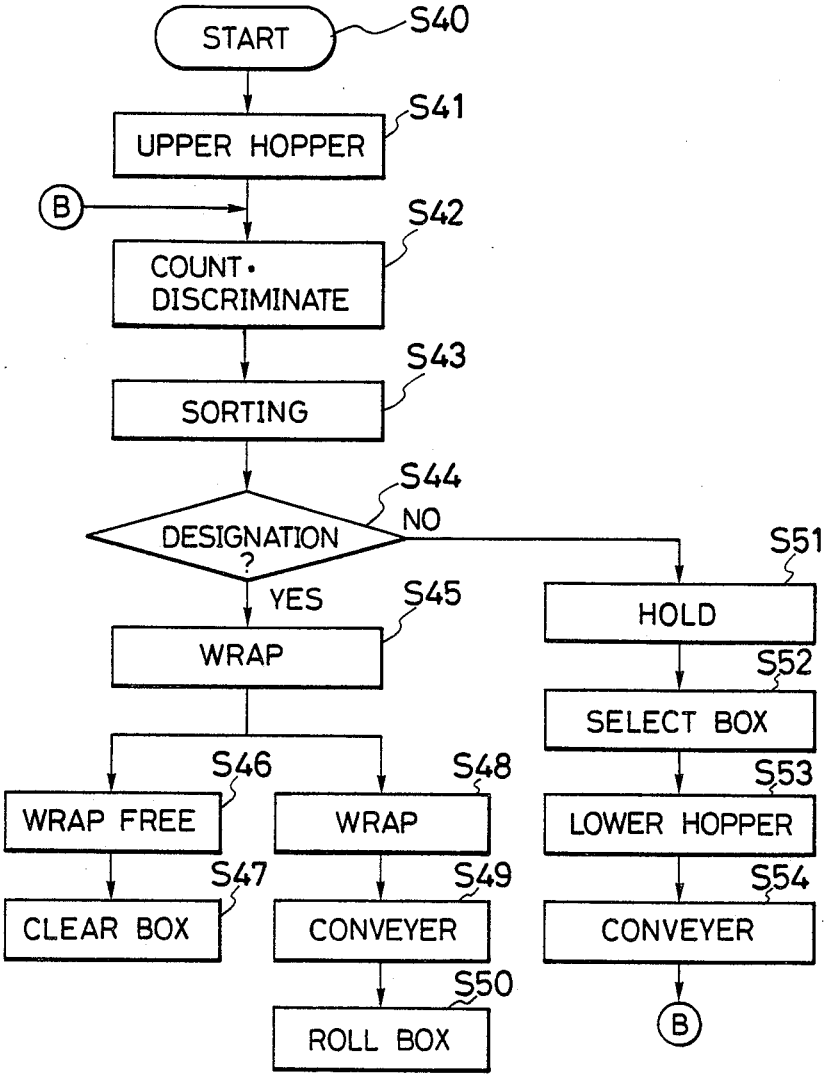

Referring to FIG. 4, there is shown a flow chart in the case where coins are received, wrapped and stored in appropriate sections. When the coins is introduced in the upper hopper 2, the process is initiated (S41). The coins are discriminated by the sensors (S42) and sorted in the passages 21, 22 (S43). In step S44, it is judged whether or not a denomination of coin to be wrapped is designated or predetermined. When a specific denomination of coin is predetermined to be wrapped, The predetermined denomination of coins in diameter are fed to the accumulating section 5. Coins other than the predetermined denomination of the coins are fed to the holding section 4A. In the primary passage 21, the coins of which diameter is bigger than the predetermined denomination of coins climb up the inclined surface of the guide member 26 to be advanced straightly and fall from the tip end of the inclined surface 27 to be introduced into the holding section A through a chute (not shown). On the other hand, coins of which diameter is smaller than the predetermined denomination of coins fall through the opening 29 in the secondary passage 2 and are introduced into the holding section 4A through the chute. As a result, only the predetermined denomination of coins are introduced into the accumulating section 5 from the terminal 23 of the secondary passage 22. The guide member 26 and passage rails 28, 28 are controlled by a cam mechanism to change a denomination of the coins to be introduced into the accumulating section 5 manually or automatically by actuating a motor by means of a switch.

When a predetermined number of coins are stacked in the accumulating section 5, the stacked coins are fed to the wrapping section 8 and wrapped (S45). The number of the accumulated coins may be checked in a manner that the number of the coins passing through the sensors 30 or the terminal 23 of the secondary passage 22 are counted. Each when the number of the stack coins in the accumulating section 5 reaches a predetermined value, the stacked coins are fed to the wrapping section 8. When the number of the coins fed to the wrapping section 8 is short of the predetermined value, the coins fall among the wrapping rolls 42, 42, 42 to be excluded and introduced into the clear box 9 (S46, S47). When the number of the stacked coins reaches the predetermined value, the coins are wrapped thereafter fed to the roll box 11 through the conveyer 10 (S48, S49, S50).

In the step S44, the coins other than the predetermined denomination of coins are fed to the holding section 4A (S51). However the coins pass through the holding section 4A because the bottom plates 31A, 31B are opened in this mode. The coins which passed through the holding section 4A are fed to the selecting box 4B. The gate 33 of the selecting box 4B is opened provided that both the upper and lower hopper 2, 6 are empty. And the coins in the selecting box 4B are fed to the lower hopper for the next wrapping process for another denomination of coins (S53). The conveyer 7 is actuated to transfer the coins from the lower hopper 6 to the upper hopper 2 provided that the upper hopper 2 is empty. Then, the same processes are repeated for the denomination of coins.

Figure 5:
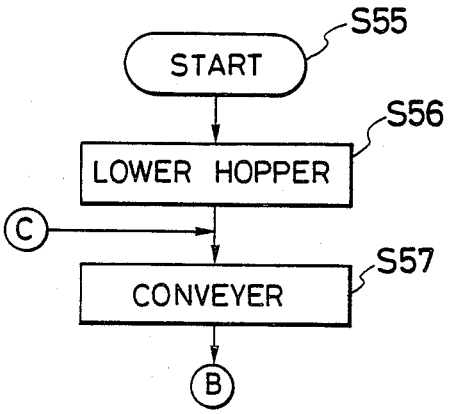

As shown in FIG. 5, when the amount of coins to be processed is massive, the coins can be fed through the lower hopper 6 in view of the heavy weight so that the burden of the operator can be reduced (S55). In this case, the conveyer 7 is actuated to transfer the coins from the lower hopper 6 to the upper hopper 2 prior to the discriminating step S42 (S56, S57).

According to the process aforementioned above, the coins fed to the machine 1 can be wrapped in any order of the denomination thereof. Alternatively the order of the denomination of coins which are wrapped can be set in such a manner that the distance between the passage rails 28, 28 is reduced regularly. In this case, the coins are wrapped in size order of decreasing diameter, i.e. 500 yen, 10 yen, 100 yen, 5 yen, 50 yen and 1 yen. In this mode, the guide member 26 can be omitted. The guide member 26 can be controlled so as to wrap the coins in size order of increasing diameter. In this mode, the passage rails 28, 28 of the secondary passage 22 can be omitted. Further the machine 1 can be controlled to wrap the coins in a sequence of the number of the coins in each denomination fed to the machine 1. Where the coins are wrapped in a sequence from a denomination of larger number of coins to a denomination of smaller number of coins, the processing time can be reduced because the number of the coins circulating in the machine 1 is reduced.

A denomination of coins to be wrapped can be changed at any time after all the coins fed to the machine 1 pass through the primary and secondary passages 21, 22 and before the counting process for another denomination of coins is initiated.

Wrapping operation can be carried out not only each when the coins are fed to the machine 1 but also when the amount of the coins stored in the machine 1 attains to a certain amount.

It will be apparent from the above description that many modifications and variations may be made by those skilled in the art without apart from the scope of the claimed invention as attached.

We claim:

1. A coin receiving and wrapping machine comprising:

upper hopper means for receiving coins to be processed, first passage means for transporting received coins, discriminating means provided in said first passage means for discriminating denominations and genuineness of received coins and counting the value of genuine received coins, first coin excluding means provided in the vicinity of one end of the first passage means for excluding coins having a larger diameter than that of a predetermined denomination of coins and feeding the coins of the predetermined denomination and those having a smaller diameter than that of the predetermined denomination of coins to second passage means for transporting received coins, second coin excluding means provided in the second passage means for excluding coins having a smaller diameter than that of the predetermined denomination of coins, accumulating means for receiving said predetermined denomination of coins to accumulate them, wrapping means provided downward of said accumulating means for wrapping said predetermined denomination of coins in the form of a coin stack, holding means removably mounted on said machine for temporarily holding the coins excluded by said first and second coin excluding means, selecting box means removably mounted on said machine and positioned downward of said holding means for receiving the coins from the holding means and for discharging the coins introduced from the holding means, lower hopper means located at the lower portion of the machine for receiving said coins discharged from the selecting box means and coins which are introduced through opening means opened to the outside of the machine, the selecting box means being provided with inlet means adapted to be communicated with the holding means when the selecting means is mounted on the machine and provided with outlet means which can be opened by applying a key from the outside of the machine, and transporting means for transporting the coins introduced into said lower hopper means from the lower means to the upper hopper means.

2. A coin receiving and wrapping machine in accordance with claim 1 wherein the machine further comprises storing means for storing the wrapped coins wrapped in the wrapping means.

3. A coin receiving and wrapping machine in accordance with claim 1 wherein the first coin excluding means comprises wall means engageable with a side face of the predetermined denomination of coins to deflect the moving direction of the received coins having a diameter not larger than that of the predetermined denomination of coins and inclined surface means onto which the received coins having a larger diameter than that of the predetermined denomination of coins climb up and move straight, and which further comprises denomination setting means for setting a denomination of coins to be introduced into the accumulating means to control the position of said wall means.

4. A coin receiving and wrapping machine in accordance with claim 3 wherein the machine further comprises control means for changing a denomination of coins to be introduced into the accumulating means set by the denomination setting means in the order of the number of the coins which pass through the discriminating means based on a discrimination by the discriminating means each when all the coins in the upper hopper are introduced into the discriminating means.

5. A coin receiving and wrapping machine in accordance with claim 1 wherein the lower hopper means is accessible from the outside of the machine so that coins can be introduced directly into the machine through the lower hopper means.

* * * * *